US006148018A

United States Patent [19]

Garcia et al.

[11] Patent Number: 6,148,018

[45] **Date of Patent: *Nov. 14, 2000**

[54] HEAT FLOW SENSING SYSTEM FOR AN INDUCTION FURNACE

[75] Inventors: Jose A. Garcia, Warren; David A. Lazor, Hubbard; Jack L. McMillin, Warren, all of Ohio

[73] Assignee: Ajax Magnethermic Corporation, Warren, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/960,397

[22] Filed: Oct. 29, 1997

[51] Int. Cl.[7] ..... H05B 6/06

[52] U.S. Cl. ..... 373/145; 338/254

[58] Field of Search ..... 373/145, 148, 373/149, 151, 155, 156; 73/359; 219/667; 338/254, 314; 392/388

[56] References Cited

U.S. PATENT DOCUMENTS

| | | | |
|---|---|---|---|
| 1,778,398 | 10/1930 | Northrup . | |
| 1,922,029 | 8/1933 | Chesnut . | |
| 2,990,542 | 6/1961 | Seitz . | |
| 3,845,706 | 11/1974 | Strimple et al. | 136/232 |
| 3,987,236 | 10/1976 | Kohler et al. | 373/145 |
| 4,149,066 | 4/1979 | Niibe | 219/505 |
| 4,201,882 | 5/1980 | Kolotilo et al. . | |
| 4,426,569 | 1/1984 | Miller et al. | 392/388 |
| 4,482,801 | 11/1984 | Habata et al. | 219/540 |
| 4,538,054 | 8/1985 | De La Bretoniere | 219/545 |
| 4,656,339 | 4/1987 | Grise | 219/528 |
| 4,788,417 | 11/1988 | Graflind | 219/528 |
| 4,989,218 | 1/1991 | Tateno | 373/145 |
| 5,229,582 | 7/1993 | Graham | 219/541 |
| 5,319,671 | 6/1994 | Hopf . | |
| 5,479,437 | 12/1995 | Hayashi . | |
| 5,629,073 | 5/1997 | Lovell | 428/206 |
| 5,661,749 | 8/1997 | Hayashi | 373/145 |

*Primary Examiner*—Teresa Walberg
*Assistant Examiner*—Quang Van
*Attorney, Agent, or Firm*—Fay, Sharpe, Fagan, Minnich & McKee, LLP

[57] ABSTRACT

An induction melting furnace includes a detection system for sensing metal penetration into a wall of the furnace depending upon detecting heat flow from the hearth to the furnace. The furnace includes a crucible including a refractory lining for holding molten metal, a coil for inductively heating the molten metal, and a power supply for supplying energy to the coil and the detection system. An electrode system is interposed between the coil and the lining comprising a sensing mat housing conductors receiving a test signal from the power supply, wherein the sensing mat includes a temperature sensitive binder that varies conductivity between the conductors in response to heat penetration through the lining. The sensing mat is preferably comprised of flexible phillosilicate mica for enhanced thermal conduction and the binder comprises an organic resin compound which carburizes at a predetermined elevated temperature.

10 Claims, 3 Drawing Sheets

HEAT FLOW SENSING SYSTEM FOR AN INDUCTION FURNACE

BACKGROUND OF THE INVENTION

This invention pertains to the art of electrical control systems and more particularly to a heat sensing device for sensing molten metal penetration through the refractory lining of an induction furnace.

The invention is particularly applicable to a sensing mat interposed between a refractory lining of a furnace and the heating coils thereof so that in the event of molten metal penetration through the refractory lining, the system can provide a warning and power application to the coils can be interrupted. However, it will be appreciated to those skilled in the art that the invention could be adapted for use in other environments besides induction furnaces, as for example, where undesired increases in temperatures are indicative of a dangerous problem and where energy application should be interrupted.

The coils of an induction furnace are spaced and insulated from the molten metal of the furnace hearth by a refractory lining. Such linings are exposed to severe stresses mechanically, chemically and thermally, and cracks in the lining will regularly occur that have to be repaired to preclude metal penetration to the coil, which with the power levels employed in such furnaces, is a dangerous situation. Ground detector systems have been most commonly employed to identify the occurrence of dangerous metal penetration through the lining. Such systems are well known and in use. The subject invention is intended to supplement the present ground detection systems and thereby enhance warning control.

In order to detect molten metal penetration in the furnace lining, the normal ground detector system has required metal penetration to be in electrical contact with the power coil. When the system is installed correctly and maintained well, on most melting systems it has proven to work satisfactorily.

The typical ground detection system has two main problems. The first is that it relies heavily on the integrity of the electrical connection between the molten metal in the furnace hearth and ground spider wires embedded in the furnace refractory floor. If the wires are not properly installed or if the floor is refractory patched, electrical continuity could be broken resulting in the inability to detect a metal penetration to the coil. If the furnace lining is made from a precast, prefired crucible shape, the spider wires will never be in electrical contact with the molten metal thereby making the system unable to detect a metal penetration to the coil.

The second problem is that it relies on actually having the metal penetration in electrical contact with the coil. Since coils now run at higher voltages, electrical insulation on the coil is critical with higher insulation requirements. In order for the ground detector to detect this penetration, the metal must first burn through all layers of the electrical insulation to contact the coil. If the metal penetration reaches the coil there will be a production down time for the furnace owner associated with repair of the furnace coil. The down time could range anywhere from a major repair (days to weeks) if severe damage occurs, or a minor repair if the penetration is just a small metal fin (hours).

In U.S. Pat. No. 5,319,679 to Hopf, a ceramic fiber foil mat encasing electrodes is used for electrical resistance measurement of the ceramic furnace lining between two electrodes. In this system, one layer of the sensing mat rests directly on the lining to emulate the lining properties of electrical conductivity and thermal conductivity. Thus, the electrical resistance of the ceramic fiber can be related to the resistance of the furnace lining.

The problem with such a system as Hopf is that it relies on an assured engagement between the sensing mat and the refractory lining. In the event such engagement is lost, reliability of the system becomes correspondingly diminished.

The present invention contemplates a new and improved control apparatus which provides an enhanced warning system as a backup to the normal ground detector system of an induction furnace. The system will detect metal penetration in the furnace lining to a high degree of reliability before it can actually pierce through the lining and the detector to actually contact the coil. The subject system's reliability is high because it does not rely on the actual contact between the conventional ground detect embedded spider wires and molten insulation; and the subject system does not rely on the metal penetration burning through the coil electrical insulation.

BRIEF SUMMARY OF THE INVENTION

In accordance with the subject invention, there is provided an induction melting furnace including a detection system for sensing metal penetration into a wall of the furnace. The furnace includes a crucible including a refractory lining for holding molten metal, a coil for inductively heating the molten metal and a power supply for supplying energy to the detection system. An electrode circuit is interposed between the coil and the lining, comprising a sensing mat housing conductors receiving a test signal from the power supply wherein the sensing mat includes a temperature-sensitive binder for varying conductivity between the conductors in response to heat penetration through the lining. The binder comprises an organic resin compound which carburizes at a predetermined temperature. The binder is selected depending upon the type of metal which is to be heated in the furnace and accordingly the elevated temperatures needed to be detected at penetration.

In accordance with more limited aspects of the invention, the sensing mat comprises a layer of flexible phillosilicate mica for maximizing thermoconduction to the binder encased therein. The binder comprises a resin compound from the group consisting of silicone resins, epoxy resins and polybutadiene resins. In accordance with a more limited aspect of the present invention, the power supply supplies a direct current to the conductors and the electrode circuit detects a leakage current between the conductors, wherein said leakage current increases in a relation to the increasing carburizing of the binder.

One benefit obtained by using the present invention is an advance warning system that provides an advance warning to a normal ground detector system in an induction furnace, that can provide warnings about metal penetration in the furnace lining to a high degree of reliability before the metal actually contacts the induction coils. System reliability is high because there is no reliance on the embedded spider wires of the ground detect system to contact with the molten metal and further because there is no reliance in the metal penetration burning through the coil electrical insulation for ground detection.

Another benefit obtained from the present invention is that lining penetration is dependent upon mere thermal conductance to the sensing mat for varying the resistance between opposite polarity electrodes installed in the furnace lining.

Another advantage of the present invention is that the carburizing which varies conductivity between the electrodes can be selected to have a different carburizing performance and dependence upon the type of metal to be heated in the furnace.

Other benefits and advantages of the subject new system will become apparent to those skilled in the art upon a reading and understanding of this specification.

BRIEF DESCRIPTION OF THE DRAWINGS

The invention may take form in certain components and structures, preferred embodiments of which are illustrated in the accompanying drawings wherein.

DETAILED DESCRIPTION OF THE PREFERRED EMBODIMENT

Figure 1:
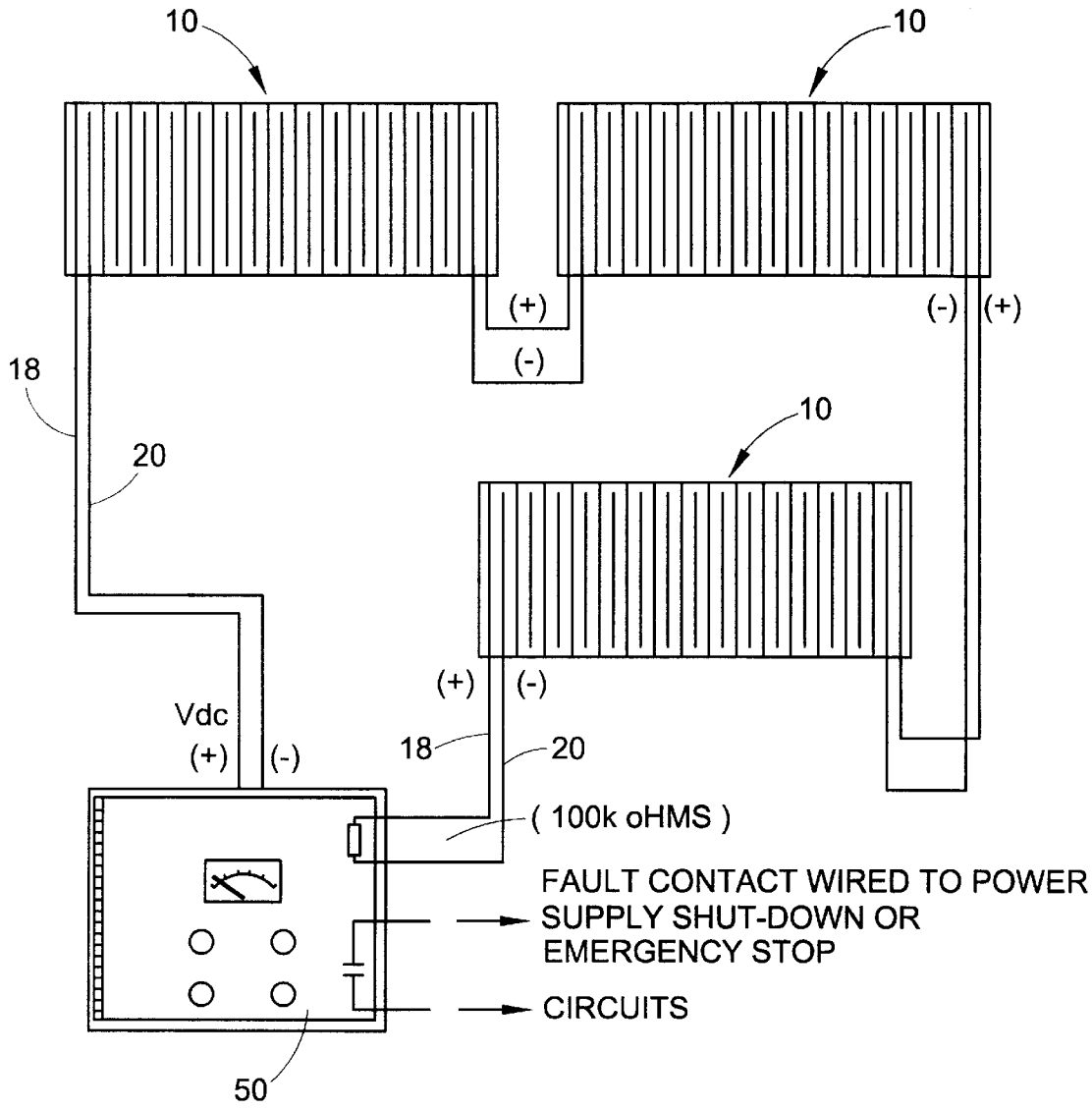
FIG. 1 is a plan view of a plurality of sensing mats connected to a controller, wherein the mats are placed into a furnace for sensing heat flow from the hearth.

Referring now to the drawings, wherein the showings are for purposes of illustrating the preferred embodiments of the invention only, and not for purposes of limiting same, the FIGURES show a heat flow sensing system particularly suitable for disposition in the walls of an induction heating furnace for sensing molten metal penetration through the refractory lining of the furnace wherein the supply of energy to the heating coils should be interrupted to avoid destructive damage to the furnace if such molten metal were to contact the coils.

With particular reference to FIG. 1 and FIGS. 5*a*–5*c*, the system is comprised of a sensing mat 10 or a plurality of series connected sensing mats 10. Each mat is comprised of opposed, thermally conductive layers 12, 14 encasing an electrode network 16 comprised of spaced first and second sensing electrodes 18, 20. The electrodes 18, 20 thus comprise a wire pair that can be interposed between the layers 12, 14. The layers 12, 14 are selected for maximum thermal conductance and preferably comprise a flexible phillosilicate mica of a predetermined thickness and composition. It is a feature of the invention that the mica layers and electrode circuit are laminated into a single bonded triplex by a carburizing binder, which not only binds the layers and electrodes into a unitary sandwich, but also provides a variable conductance between the electrodes when the sensing mat is exposed to elevated temperatures.

The binding agent preferably comprises an organic resin compound from one of two base resin families known generically as silicone and epoxy. A third alternative resin that can be used individually, or in combination with the previously mentioned resins, is polybutadiene or similar carburizing chemistries. The resins are formulated such that they will begin to out gas at a temperature range of 900° F. up to as much as 1800° F. or more, depending upon the particular metal being heated in the furnace.

As noted above, the layers 12, 14 are designed to have the highest thermal conductivity possible so that upon exposure to elevated temperatures, the temperatures will be communicated to the binders to cause a chemical reaction that will produce carbon (carburization). The carburization will decrease the resistance between the electrodes 18, 20 within the mats 10.

Figure 2:
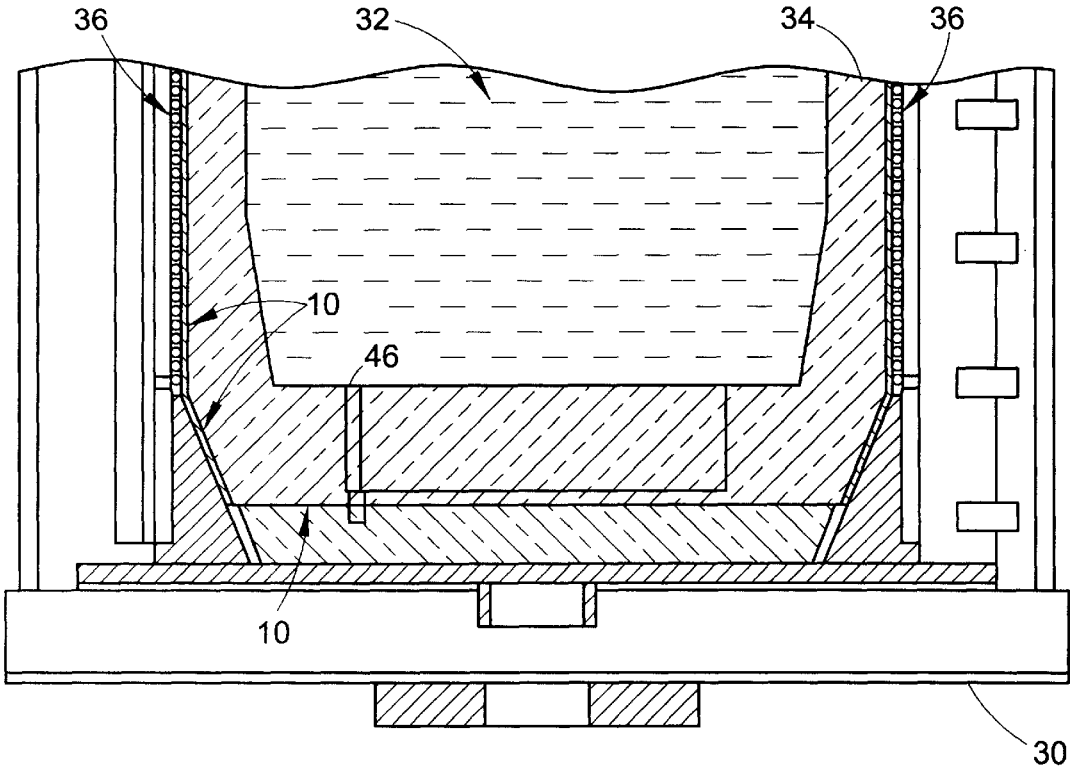
FIG. 2 is a partial cross-sectional view of a furnace for illustrating locations for the sensing mats of FIG. 1.
Figure 3:
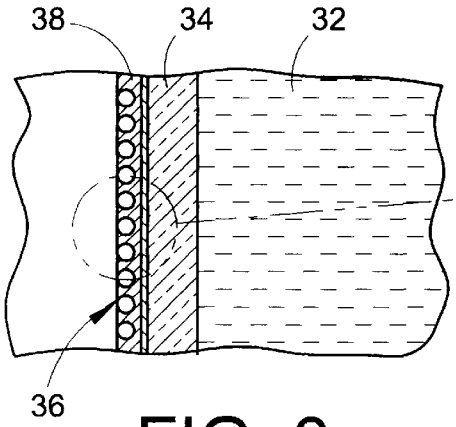
FIG. 3 is an exploded partial cross-sectional view of a sidewall of the furnace.
Figure 4:
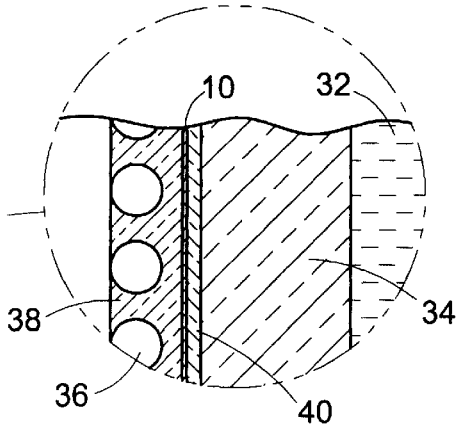
FIG. 4 is a further exploded partial cross-sectional view of the view of FIG. 3.
Figure 5A:
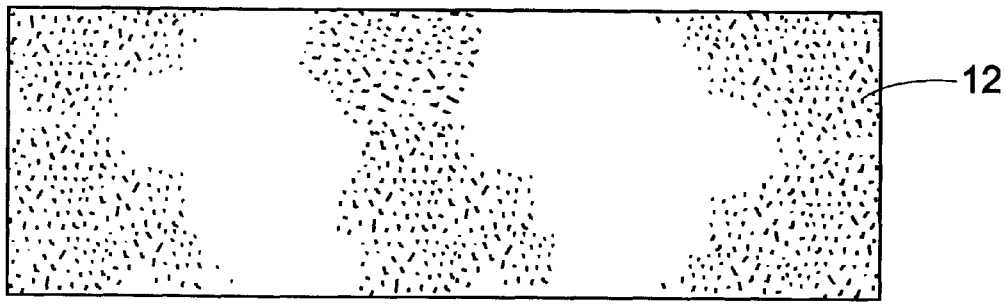
FIGS. 5*a*–5*c* illustrate the constituent layers of a sensing mat formed in accordance with the present invention.
Figure 5B:
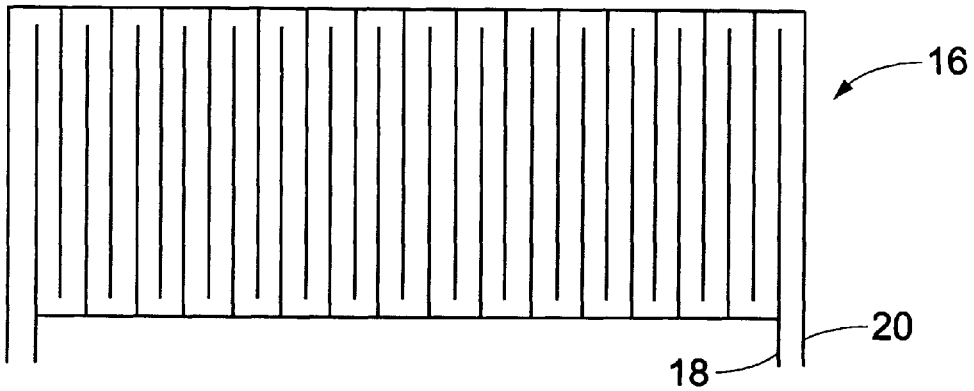
Figure 5C:
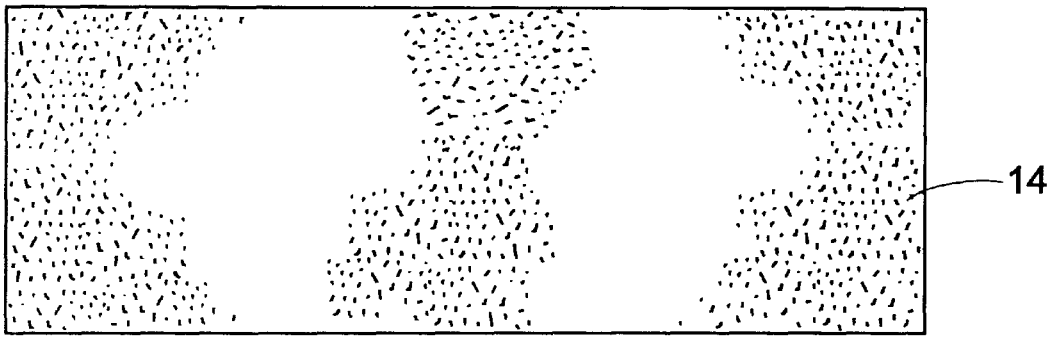

With particular reference to FIGS. 2–4, the disposition of the sensing mats within a furnace is illustrated. The furnace 30 is essentially comprised of a crucible holding molten metal 32, comprising a hot face refractory lining 34 disposed within inductive coils 36. Disposed about the coils is a grout 38 and interposed between the grout and the refractory lining 34 is a slip plane material 40. With particular reference to FIG. 4, it can be seen that the sensing mats are interposed between the slip plane material 40 and the coil grout 38. Thus, the mats 10 are placed on the inside diameter of the coil grout inside the furnace hearth. As shown in FIG. 2, the sensing mats can be disposed on both the side walls and bottom wall of the hearth, essentially adjacent the refractory material. As further noted in FIG. 2, a conventional ground detector probe 46 is included in the system.

With reference to FIG. 1, a dedicated monitor and control panel 50 controls the monitoring and operating of the system. The panel 50 comprises an electrical control board that will produce a DC output voltage to the electrodes 18, 20. From this supply of DC voltage, the system will monitor the DC current linkage supplied through the connected loads comprising the plurality of mats 10. Since the connected load is installed inside the furnace lining between the coils 36 and the molten metal contained in the hearth, the system can monitor heat flow flowing from the molten metal to the coils. The electrode circuit 18, 20 is interconnected with the control panel 50 by using cabling from the control panel out to the furnace. At a predetermined maximum leakage current setting, the circuit will actuate a fail safe relay which is normally closed to signal the power supply fault shutdown circuit (or emergency stop circuit). Also, it will actuate an alarm which will warn the system operator that metal penetration has advanced to a point that will endanger both the induction coil and the surrounding personnel. Since the trip point of fault detection is variable, dependent upon operator selection, the system can be adapted for use with a range of leakage currents. The further carburization progresses, the higher the leakage current rises until the system will trip at some predetermined value.

The system includes conventional safety checks to ensure proper operation and connection, including means for continuously monitoring broken wires (open circuits) in the interconnecting cabling as well as within the mats 10, and will also be sensitive to detected ground potentials.

Alternative features which could be included as part of the subject invention include multi-zoning the mats 10 with reference to particular position in the furnace so that the particular effected area in a "failed furnace lining" can be indicated to the operators. A processor can be included to analyze data to display furnace operating conditions, zone temperatures in areas of the furnace, lining wear or erosion trending and location. The subject invention provides an advantageous pre-warning system for identifying elevated heat flow from a furnace hearth to the coils wherein the sensing is accomplished fully within the sensing mat itself, as opposed to dependency upon adjacent refractories or metal to electrode contact.

The invention's potential applications include: (a) a coreless furnace protection in an air melting system with rammed or crucible linings; (b) coreless furnace protection in vacuum melting system with rammed or crucible linings; (c) coil protection for high temperature applications such as graphite heating, billet heating, or other forms of melting other than just induction; (d) other multiple applications associated with channel induction melting, such as bushing and coil protection, inductor case protection, throat and upper case protection; and, (e) various other thermal related applications and processes.

The invention has been described with reference to two preferred embodiments. Obviously, modifications and alterations will occur to others upon a reading and understanding of this specification, it is our intention to include all such modifications and alterations in so far as they come within the scope of the appended claims or the equivalents thereof.

Having thus described our invention, we now claim:

1. An induction melting furnace including a detection system for sensing metal penetration into a wall of the furnace, the furnace comprising:

a crucible including a refractory lining for holding molten metal, a coil for inductively heating the molten metal, a power supply for supplying energy to the detection system, the detection system including an electrode circuit interposed between the coil and the lining comprising a sensing mat housing conductors receiving a test signal from the power supply wherein the sensing mat includes a temperature sensitive binder comprising a resin compound for binding a first layer to the conductors and for sensing varying electrical conductivity of the binder between the conductors in response to heat penetration through the lining.

2. The furnace as claimed in claim 1 wherein the first layer comprises flexible phillosilicate mica for enhanced thermal conduction.

3. The furnace as claimed in claim 2 wherein the sensing mat further comprises a second layer of flexible phillosilicate mica for enhanced thermal conduction opposing the first laver such that the conductors are sandwiched between the first and second layers.

4. The furnace as claimed in claim 1 wherein said binder comprises an organic resin compound which carburizes at a predetermined temperature.

5. The furnace as claimed in claim 4 wherein said resin is in the group consisting of silicone resins, epoxy resins and polybutadiene resins.

6. The furnace as claimed in claim 1 wherein said power supply supplies a direct current to said conductors.

7. The furnace as claimed in claim 1 wherein said electrode circuit detects a leakage current between said conductors, said leakage current increasing in a related manner to carburizing of the binder.

8. A flexible sensing mat disposed in a refractory lining of a coreless furnace for detecting penetration of a molten metal through the lining, said mat comprising:

opposed thermally conductive layers, a wire pair interposed between the layers, and a carburizing binder binding the layers whereby exposure of the mat to variable temperatures affects electrical conductivity between the wire pair in an identifiable manner.

9. The flexible sensing mat as defined in claim 8 wherein said binder comprises an organic resin compound from the group consisting of silicone, epoxy and polybutadiene base resins.

10. The flexible sensing mat as defined in claim 8 wherein said carburizing binder has an increase in electrical conductivity in response to an increase in temperature.

* * * * *